US005345695A

United States Patent [19]

Graham

[11] Patent Number: 5,345,695

[45] Date of Patent: Sep. 13, 1994

[54] METHOD AND APPARATUS FOR DRYING WOOD

[75] Inventor: Auston B. Graham, Granite Falls, N.C.

[73] Assignee: Armstrong World Industries, Inc., Lancaster, Pa.

[21] Appl. No.: 993,644

[22] Filed: Dec. 21, 1992

[51] Int. Cl.[5] ..... F26B 19/00

[52] U.S. Cl. ..... 34/94; 34/239

[58] Field of Search ..... 34/6, 94, 38, 239; 214/10.5 R; 248/615, 632

[56] References Cited

U.S. PATENT DOCUMENTS 3,907,130 9/1975 Hutcheson ..... 214/10.5 R 4,788,777 12/1988 Davis ..... 34/239

FOREIGN PATENT DOCUMENTS 1059493 3/1954 France .

*Primary Examiner*—Henry A. Bennett

[57] ABSTRACT

Pieces of wood to be dried are stacked in an oven with a space provided between horizontal layers of the wood to permit air flow between the pieces of wood. Means providing the spacing are channel-shaped, non-moisture absorbing strips of metal or plastic approximately ¾ inch square. The air for drying the wood will travel down the channel of the strips to help in the drying of the wood.

4 Claims, 1 Drawing Sheet

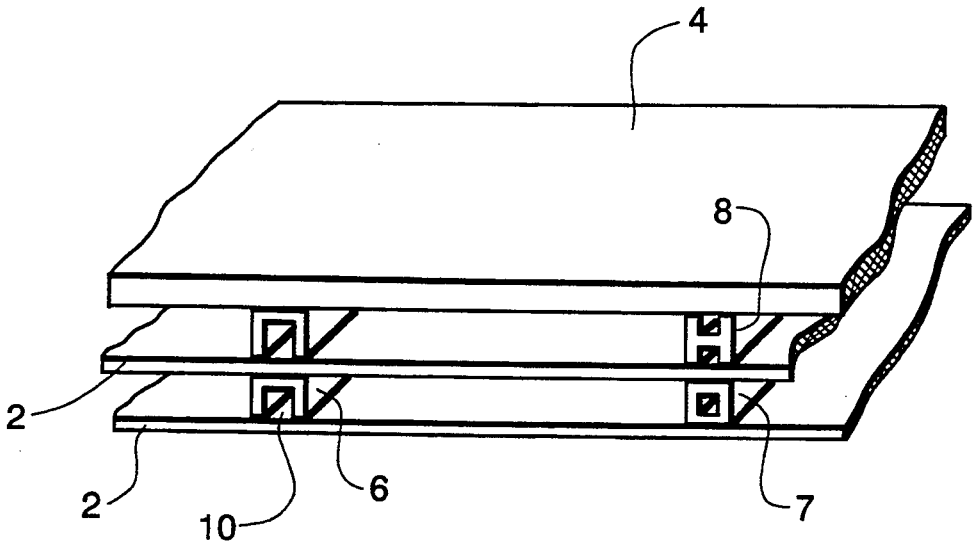
4
8
2
2
10
6
7

METHOD AND APPARATUS FOR DRYING WOOD

BACKGROUND OF THE INVENTION

1. Field of the Invention

The invention is directed to a method and apparatus for drying pieces of wood and, more particularly, to the spacing means that are placed between the horizontal layers of wood to permit the flow of air around the wood to be dried.

2. Description of the Prior Art

Currently, in the prior art, the spacing means used to separate horizontal layers of wood veneer or construction lumber are ¾ inch square sticks of pine wood. The drying of the veneer or construction lumber will require both the drying of that veneer or lumber and the wood sticks which separate the horizontal layers of veneer or lumber. Normally, in drying the veneer, it takes three and one-half days to dry the veneer. In the first day, any of the veneer not in contact with the wood sticks is dry. The remaining two and one-half days are consumed in drying the veneer lumber between the adjacent sticks on alternate horizontal layers and the sticks need to have their moisture removed therefrom so that the veneer in contact therewith will dry.

There has been some use of solid plastic sticks but without a noticeable improvement in drying times.

By using the channel-shaped, non-moisture absorbing material of the invention herein, it is possible to lower the drying of veneer to one and one-half days.

SUMMARY OF THE INVENTION

The invention is directed to a method of drying pieces of wood wherein the wood pieces are stacked in an oven with a spacing between the horizontal layers of the wood. The spacing is provided by means of channel-shaped, non-moisture absorbing material made of metal or plastic.

The spacing means or sticks will be non-staining, relative veneer and, therefore, should be either aluminum or plastic. With construction lumber, where staining would not matter, they could be made of steel or other materials which would be affected by moisture. They could be in an inverted U shape, or they could be an H shape depending upon the strength that is needed in the spacing means to support a stack of lumber. The important thing is that the sticks which provide the spacing between layers of wood have channels therein to permit air flow down the channels to contact the wood to be dried that is adjacent to the sticks forming the spacing between the horizontal layers of lumber.

BRIEF DESCRIPTION OF THE DRAWING

The FIGURE is a perspective view of the invention in use.

DESCRIPTION OF THE PREFERRED EMBODIMENTS

It is necessary to take pieces of wood which are to be used particularly in building furniture, but also in building homes, from a moisture content of as high as 80% after it has been air dried to a moisture content of 5 to 7% just prior to the use of the wood to build furniture products or homes. The wood being dried could be wood veneer which ranges in thickness from 1/24 to ⅛ of an inch in thickness to hard wood which could be anywhere from 1 to 2 inches in thickness to construction lumber which could vary from ¾ of an inch upward. The invention herein is applicable to all the above forms of wood products which are broadly called wood pieces.

In the drawing, there is shown veneer sheets 2 which are very thin and a piece of construction lumber 4 which is noticeably thicker than veneer. Normally, veneer and the thicker lumber would not be dried at the same time but, for sake of simplicity, are shown in the drawing in that manner. The wood pieces to be dried are stacked in horizontal layers with a spacing between the horizontal layers so air can pass between the layers of wood to dry the wood. Normally, the spacing would be formed by the use of ¾ inch square pine sticks which rest on the lower horizontal layer and support the horizontal layer thereabove establishing roughly a ¾ inch space between the horizontal layers. The sticks would be spaced approximately one foot apart across a horizontal plane.

In the FIGURE, there is shown an inverted hat-shaped stick 6, a box-shaped stick 7 and an H-shaped stick 8 which are used to replace the conventional ¾ inch pine sticks. When veneer is being dried, the sticks 6, 7 and 8 must be made of aluminum, plastic or some other material which will be unaffected by moisture so that the veneer will not be stained. Where staining is not a problem, as with some forms of construction lumber, then steel could be used. The sticks 6, 7 and 8 are provided with a channel 10 regardless of whether they are the inverted U shape as shown for 6, or the box shape as shown for 7, or the H shape as shown for 8. The sticks 7 and 8 are formed with the H shape or box shape because they provide more strength to help support the thicker pieces of wood. When veneer alone is used, the inverted U shape is more than adequate to support the weight of a stack of veneer to be dried. It is important that the sticks 6, 7 and 8 be non-moisture absorbing and, therefore, do not have moisture that must be removed therefrom. Also, in a large area, the sticks must not contact both sides of the pieces of wood. Due to the channel in the sticks and the spacing between the sticks, both sides or at least one side of almost every piece of veneer is contacted by the flow of hot air in the oven.

What is claimed is:

1. A stack of wood pieces to be dried comprising:

(a) a stack of wood pieces with spacing between horizontally spaced layers of wood pieces; and (b) the improvement comprising:

(1) the spacing being provided by means of channel-shaped, non-moisture absorbing material separate from the wood pieces formed in an inverted U shape with a horizontal base and two parallel sides perpendicular to said base with the top and bottom of the U contacting the wood pieces, said open end of the U shape being the bottom of the U shape.

2. A stack of wood pieces to be dried comprising:

(a) a stack of wood pieces with spacing between horizontally spaced layers of wood pieces; and (b) the improvement comprising:

(1) the spacing being provided by means of channel-shaped, non-moisture absorbing material separate from the wood pieces formed in an H shape with the top and bottom of the H contacting the wood pieces, said open ends of the H shape being the top and bottom of the H shape.

3. A stack of wood pieces to be dried according to claim 1 wherein:

(a) the wood pieces to be dried are veneer and the U shape means providing spacing between the layers of veneer are positioned directly above each other.

4. A stack of wood pieces to be dried according to claim 2 wherein:

(a) the pieces of wood to be dried are hard wood construction lumber.

* * * * *